United States Patent [19]

Massarsch

[11] Patent Number: 4,906,141

[45] Date of Patent: Mar. 6, 1990

[54] METHOD OF ANCHORING A PREFABRICATED PILE INTO THE GROUND AND PILE FOR CARRYING OUT THIS METHOD

[75] Inventor: Rainer Massarsch, La Hulpe, Belgium

[73] Assignee: Compagnie Internationale des Pieux Armes Frankinoul, Belgium

[21] Appl. No.: 180,976

[22] PCT Filed: Jul. 17, 1987

[86] PCT No.: PCT/BE87/00011

§ 371 Date: Mar. 18, 1988

§ 102(e) Date: Mar. 18, 1988

[87] PCT Pub. No.: WO88/00629

PCT Pub. Date: Jan. 28, 1988

[30] Foreign Application Priority Data

Jul. 21, 1986 [FR] France ..... 86 10558

[51] Int. Cl.[4] ..... E02D 5/30

[52] U.S. Cl. ..... 405/244; 405/237; 405/256

[58] Field of Search ..... 405/233, 237, 238, 242, 405/244, 248, 256

[56] References Cited

U.S. PATENT DOCUMENTS

| | | | |
|---|---|---|---|
| 1,026,144 | 5/1912 | Bignell | 405/248 X |
| 3,492,823 | 2/1970 | Lamberton . | |
| 4,060,994 | 12/1977 | Chitis | 405/244 X |
| 4,547,106 | 10/1985 | Lisker | 405/244 X |

FOREIGN PATENT DOCUMENTS

| | | |
|---|---|---|
| 322934 | 7/1920 | Fed. Rep. of Germany . |
| 1215827 | 4/1960 | France . |
| 1417746 | 10/1965 | France . |
| 2159613 | 6/1973 | France . |

*Primary Examiner*—David H. Corbin

*Attorney, Agent, or Firm*—Steinberg & Raskin

[57] ABSTRACT

The present invention concerns a method of anchoring a prefabricated pile into the ground as well as a pile for carrying out this method. The prefabricated pile (P) comprises essentially at its lower portion a recess (1) containing a bladder (2) connected to a source of material under pressure through the agency of a pile-line (3) extending along the axis of the pile, so that, when the bladder (2) is inflated, a radial deformation of the lower portion of the pile is provided to thus supply the latter with a base. The pile according to this invention is useful for any kind of works and presents an increased strength against tensile and compressive stresses.

12 Claims, 1 Drawing Sheet

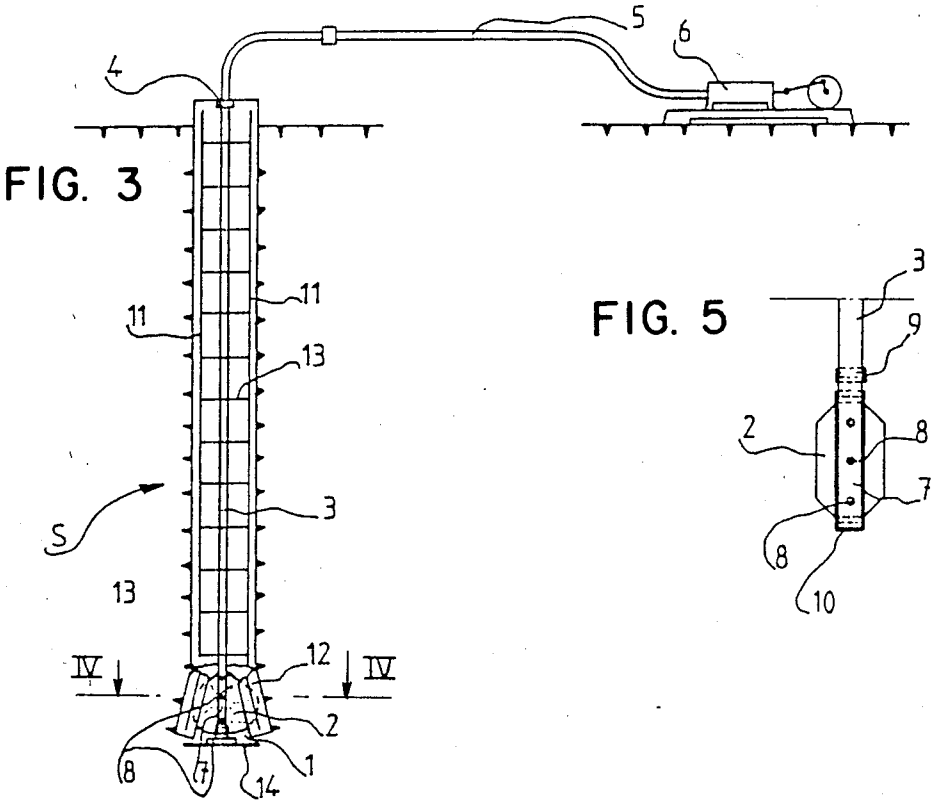
FIG. 3
FIG. 5
IV
IV
S
13
11
3
12
2
1
14
8
7
10
9
5
6
4
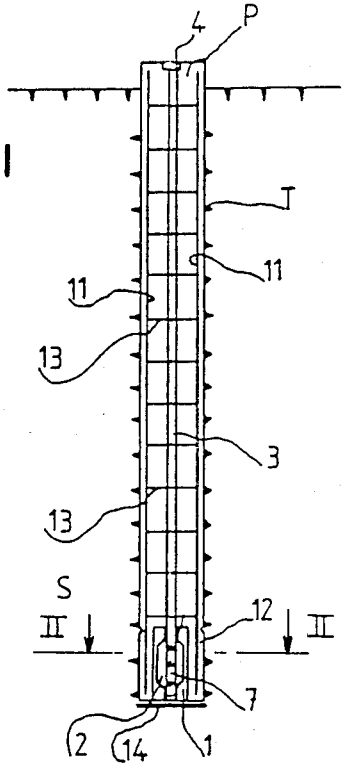
FIG. 1
II
II
S
P
4
11
13
3
12
7
1
2
14
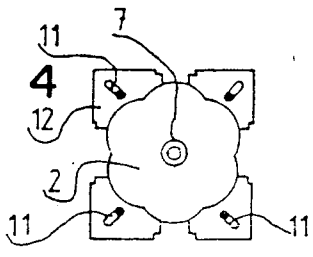
FIG. 4
11
12
2
7
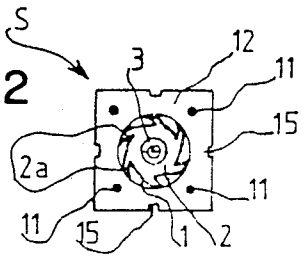
FIG. 2
S
11
12
15
3
2
1
2a

METHOD OF ANCHORING A PREFABRICATED PILE INTO THE GROUND AND PILE FOR CARRYING OUT THIS METHOD

BACKGROUND OF THE INVENTION

The present invention relates essentially to a method of anchoring a prefabricated pile into the ground.

It is also directed to a pile for carrying out this method.

It is already known to make prefabricated piles comprising a base enlarged with respect to the shaft of the pile. Thus, when the pile is located in the ground, the base allows the pile to bear very heavy loads.

When it is desired to arrange piles into a light soil, it is possible to use piles with previously-made integral bases, since such piles would easily penetrate into the soil.

This will obviously not be the case with hard soils, where the base would prevent the pile from being driven in, and the pile may besides become broken under the effect of the driving operation.

It was therefore necessary to provide a pile which may easily penetrate into any types of soils and which may nevertheless comprise a base making it capable of withstanding heavy loads as well pulling forces.

SUMMARY OF THE INVENTION

The present invention is precisely aiming at accomplishing the aforementioned objects.

For that purpose, the invention provides a method of anchoring a prefabricated pile into the ground and which is of the kind inserting this pile into the ground through a driving operation or into a previously bored hole, characterized in that, after that insertion, a substantially radial deformation of the lower portion of the pile is provided to form a base imparting to the pile an increased strength against tensile or compressive stresses.

According to another characterizing feature of this method, the aforesaid deformation is carried out by inflating a bladder or the like incorporated into the lower portion of the pile, such an inflating step being performed by means of a hardenable compound such for instance as cement mortar or concrete.

It should further be pointed out that the deformation of the lower portion of the pile is carried out in a controlled manner on the inner walls of this lower portion which contains the bladder.

The invention is also directed to a pile for carrying out the method and meeting either of the aforesaid characterizing features, this pile being essentially characterized in that it comprises at its lower portion a recess containing at least one bladder or the like connected to a source of fluid under pressure through the agency of at least one pipe-line extending along the axis of the pile.

The aforesaid pipe-line comprises an end portion formed with ports which extends inside the recess and about which the bladder is arranged.

The pile according to the invention is further characterized in that the aforesaid end portion is removably connected, through screwing means for instance, to the pipe-line extending along the axis of the pile.

According to still another characterizing feature of the invention, the pile comprises longitudinal reinforcing bars which extend down into the wall of the aforesaid recess.

It should also be specified here that the bladder housed within the recess comprises a wall formed of parts foldable towards the axis of this bladder.

It is also possible to provide failure-initiating notches located on the outer periphery of the lower portion of the pile.

A plate for closing the recess may further be provided at the bottom end of the pile.

BRIEF DESCRIPTION OF THE DRAWINGS

The invention will be better understood and further characterizing features and advantages thereof will appear more clearly as the following detailed description proceeds with reference to the accompanying drawings given by way of example only and wherein:

FIG. 1 is a view in vertical section of a hole formed into the ground and containing a prefabricated pile according to the principle of the invention;

FIG. 2 is a cross-sectional view taken upon the line II—II of FIG. 1;

FIG. 3 is a sectional view similar to FIG. 1 but showing the pile base made by inflating the bladder incorporated into the lower portion of the pile;

FIG. 4 is a cross-sectional view taken upon the line IV—IV of FIG. 2; and FIG. 5 is a view in axial section of the end portion of the pile-line feeding the bladder.

DESCRIPTION OF THE PREFERRED EMBODIMENTS

Referring to FIGS. 1 and 3, there is seen a hole T provided in the soil S and into which is inserted a prefabricated pile P according to the invention.

This pile P, which is for instance made of concrete, comprises at its lower portion a recess 1 in which is accommodated a bladder 2 connected to a pipe-line 3 extending for instance along the longitudinal axis of the pipe P.

The pipe-line 3, as seen in FIG. 3, may be connected with its opening end 4 to another pipe-line 5, itself connected to a pump 6 for injecting a hardenable material into the bladder 2. The injected material may be any suitable material, such for instance as cement mortar, concrete or even a suitable resin.

More specifically, the pipe-line 3 comprises an end portion 7 which is formed with holes and about which is secured in fluid-tight relationship the bladder 2 which exhibits the shape of a sheath. The bladder may be made of any suitable material, such as a woven or non-woven fabric or also a resiliently deformable synthetic material.

Moreover, the bladder 2, as well shown in FIG. 2, may comprise on its periphery, portions which are foldable like an umbrella, so that when the bladder 2 is inflated by the material supplied by the pump 6, the initially folded-back portions 2*a* will open and the bladder or jacket 2 will fully spread out along one diameter which is substantially greater than the initial diameter of the bladder in the folded-back position.

Reverting to the end portion 7 of the pipe-line 3, there is seen in FIG. 5 that it may be removably connected to the remaining portion of the pipe-line 3 through the medium of a screw-threaded ring 9, for instance. It should be pointed out that the pipe-line 3 and its end portion 7 may for instance be made of a suitable synthetic material such as poly(vinyl chloride), said end portion being of course closed at 10.

As well shown in FIGS. 1 to 4, the pile P comprises longitudinal reinforcing bars 11 which extend down into the wall 12 defining the recess 1. Moreover, the pile P may comprise stirrups 13 as well known per se.

At the lower end of the pile P, a cover plate 14 is provided for closing the recess 1.

As to the wall 12 of this recess, it may comprise on the outside, as well shown in FIG. 2, notches 15 forming failure-initiating points of the lower portion of the pipe P under the effect of the inflation of the bladder or bag 2 as will now be described in a more detailed manner by explaining how the anchoring of the pile P into the ground S is carried out.

The prefabricated pipe P together with its bladder 2 housed within the recess 1 is at first inserted into the hole T as shown in FIG. 1.

Then, with the pump 6, concrete for instance is injected into the bladder 2, the concrete successively passing into the pipe-line 5, the pipe-line 3 and the holes 8 formed in the end portion 7 of the pipe-line 3.

Then, as well shown in FIGS. 3 and 4, the bladder or bag 2 will spread out and cause the lower portion of the pile P, i.e. the wall 12 of the recess 1, to undergo a radial deformation.

This deformation may advantageously be carried out in a monitored manner, so that the wall 12 would more or less burst or be divided into pieces in substantially symmetrical relation to the axis of the pipe P, as well shown in FIG. 4.

It should be pointed out that the lower portion of the pile P, after the bursting of a number of pieces, will still and always remain attached to the remaining upper portion of the pipe P, owing to the reinforcing bars 11 which, as previously set forth, extend into the wall 12 of the recess 1.

Therefore, there has been provided, according to the invention, a prefabricated pile which may be inserted very easily into any kinds of soils, even hard soils, in view of its regular initial configuration from one end to the other one, and which may thereafter be provided with a base always connected to the remaining part of the pile and imparting to the latter an outstanding strength against tensile and compressive stresses.

It should be added that the pile according to this invention may be made of concrete reinforced with metal fibers or the like to cause the deformation to be more symmetrical without any risk of failure or breakage and may exhibit any cross-sectional shape such as a polygonal or cylindrical shape, it being understood that the square shape shown in particular in FIG. 2 should not be construed as limiting the scope of the invention.

Therefore, the invention is not at all restricted to the embodiment of the pile described and shown, which has been given by way of example only.

In this respect, it would well be possible, without departing from the scope of the invention, to contemplate the use of any material for making the bladder or bag 2 or for carrying out the inflation of that bladder.

The invention therefore covers all the technical equivalents of the means described as well as their combinations, if same are carried out according to its spirit.

What is claimed is:

1. Prefabricated tubular concrete pile adapted to be inserted and anchored into the ground by being driven thereinto or into a previously drilled bore-hole, having a lower portion substantially radially deformable under the effect of a material injected under pressure into that lower portion to form an enlarged base, the deformable lower portion exhibiting in a wall thereof longitudinal notches forming failure-initiating lines, and extending down to the lower end of the pile, said deformable lower portion defining a recess containing at least one bladder (2) connected to a separate source of said material under pressure, through the medium of at least one pipe-line extending substantially along an axis of the pile, and said pile comprising deformable longitudinal reinforcing elements (11) which extend into the wall of the pile at least in a transition area between said lower portion and a remaining upper portion and adapted to keep the lower portion, after its deformation, attached to the remaining upper portion of the pile.

2. Pile according to claim 1, characterized in that it comprises at its lower end, a plate (14) for closing the recess (1).

3. Pile according to claim 1, characterized in that said pipe-line (3) comprises an end portion (7) formed with ports (8) and which extends into the recess (1) and about which the bladder (2) is secured.

4. Pile according to claim 3, characterized in that said end portion (7) is removably connected, to the pipe-line (3).

5. Pile according to claim 8, characterized in that said bladder (2) comprises a wall formed of parts (**2*a***) foldable towards the axis of this bladder.

6. Pile according to claim 1, characterized in that the reinforcing elements (11) are made up of longitudinal reinforcing bars.

7. Pile according to claim 8, characterized in that it is made of concrete reinforced with wires, the reinforcing elements being made up of at least some of the said fibers.

8. The pile of claim 1, wherein said material under pressure is a hardenable compound.

9. The pile of claim 1, wherein said hardenable compound is cement, mortar, or concrete.

10. The pile of claim 4, comprising screwing means for connecting said end portion to said pipeline.

11. The pile of claim 6, being made of concrete.

12. The pile of claim 7, wherein said fibers are metallic.

* * * * *